US008900018B2

(12) United States Patent
Riepe et al.

(10) Patent No.: US 8,900,018 B2
(45) **Date of Patent: *Dec. 2, 2014**

(54) SYSTEM PLUG CONNECTOR

(71) Applicant: Harting Electric GmbH & Co. KG, Espelkamp (DE)

(72) Inventors: Dieter Riepe, Luebbecke (DE); Martin Schmidt, Luebbecke (DE); Nicole Spilker, Luebbecke (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/109,699

(22) Filed: Dec. 17, 2013

(65) Prior Publication Data

US 2014/0179172 A1 Jun. 26, 2014

Related U.S. Application Data

(63) Continuation of application No. 13/514,700, filed as application No. PCT/EP2009/008780 on Dec. 9, 2009, now Pat. No. 8,668,530.

(51) Int. Cl.
*H01R 13/502* (2006.01)
*H01R 13/52* (2006.01)
*H01R 13/518* (2006.01)

(52) U.S. Cl.
CPC ..... *H01R 13/52* (2013.01); *H01R 13/5213* (2013.01); *H01R 13/518* (2013.01)
USPC ..... 439/701; 439/532; 439/716

(58) Field of Classification Search
USPC ..... 439/532, 701, 716
See application file for complete search history.

(56) References Cited

U.S. PATENT DOCUMENTS

| | | | | |
|---|---|---|---|---|
| 3,456,231 | A * | 7/1969 | Zimmerman, Jr. et al. | 439/532 |
| 4,090,764 | A | 5/1978 | Malsby et al. | |
| 4,659,162 | A | 4/1987 | Cartesse | |
| 4,682,839 | A * | 7/1987 | Bryce | 439/598 |
| 4,773,867 | A | 9/1988 | Keller et al. | |
| D372,222 | S * | 7/1996 | Matthews | D13/154 |
| 5,924,898 | A | 7/1999 | Dutton et al. | |
| 7,316,591 | B2 | 1/2008 | Ferderer | |
| 8,292,676 | B2 | 10/2012 | Schmidt et al. | |
| 8,668,530 | B2 * | 3/2014 | Riepe et al. | 439/701 |
| 2011/0217880 | A1 | 9/2011 | Schmidt et al. | |
| 2012/0244754 | A1 | 9/2012 | Riepe et al. | |
| 2013/0164997 | A1 | 6/2013 | Schmidt et al. | |

FOREIGN PATENT DOCUMENTS

| | | |
|---|---|---|
| EP | 0 183 587 | 6/1986 |
| GB | 1 542 971 | 3/1979 |

* cited by examiner

*Primary Examiner* — James Harvey
(74) *Attorney, Agent, or Firm* — Jacobson Holman Hershkovitz, PLLC.

(57) ABSTRACT

A plug connector system for a plug connection between electrical conductors, wherein the plug connector system accommodates plug modules with electrical contacts contained therein. The plug modules are first inserted into a region of a holding frame. A plug insert may be arranged in the holding frame and locked in place, and then subsequently slid 90° sideways in the holding frame and held in place. The holding frame is designed as a self-supporting part of the plug connector system, for the purpose of accommodating the plug modules, and can provide protection from external influences by means of a surrounding housing. The plug modules can be inserted into the holding frames from both sides, meaning in the direction in which the connection is made, or also in the opposite direction.

10 Claims, 12 Drawing Sheets

SYSTEM PLUG CONNECTOR

CROSS-REFERENCE TO RELATED APPLICATION

This application is a continuation of U.S. application Ser. No. 13/514,700, filed Jun. 8, 2012, which was a nationalization of PCT/EP09/008780 filed Dec. 9, 2009 and published in German, hereby incorporated by reference.

BACKGROUND OF THE INVENTION

1. Field of the Invention

The invention relates to a plug connector system, consisting of a first holding frame which holds electrical terminals therein in separate plug modules, wherein the first holding frame is protected against external influences by means of a housing which surrounds the same. The plug connector system is provided for the purpose of establishing contact with plug modules held in a second holding frame.

Such a plug connector system was conceptualized with the intention of simplifying the installation thereof, and to design plug connections having plug modules in a housing to the requirements of an industrial environment.

2. Description of the Related Art

A holding frame for plug connector modules is known from EP 0 860 906 B1, where said frame is intended for installation in plug connector housings and has a mounting frame consisting of two halves connected to each other by hinges. Plug connector modules can be inserted into said halves.

In addition, a holding frame manufactured from plastic is known from U.S. Pat. No. 7,316,591 B2, wherein multiple plug modules arranged next to each other are held between wall segments divided by slots.

A particular disadvantage of such known holding frames is that the same must always be inserted into a further housing and then screwed in, wherein care must be taken to consider the direction of current flow and therefore the direction in which the contacts inserted into the plug modules face, and that a prespecified direction of installation from the holding frame to the plug connector housing was always prespecified.

SUMMARY OF THE INVENTION

The invention therefore addresses the problem of designing a plug connector housing structure which makes do without separate fastening means, and which enables the installation, from both the plug end and the connection end of each plug connector piece, of modules having terminals, wherein, also, in principle the direction of current flow is also not dependent on the design of the contact.

This problem is addressed in that both the first holding frame and the second holding frame include a rectangular feedthrough opening, the same having devices for holding the plug modules, in that a plug insert is arranged in each of the rectangular feedthrough openings, wherein the plug modules are arranged such that the same can be inserted into the holding frame and can be fixed in the rectangular feedthrough opening, and in that the plug modules can be inserted into the rectangular feedthrough opening from both sides, meaning from the plug side as well as from the connection side.

Advantageous embodiments of the invention are given in the dependent claims.

The invention is a plug connector system which accommodates terminals contained in plug modules, wherein the plug modules are held in a holding frame such that they can be connected and can be released. While one of the holding frames is permanently built into a device supplied with the current, as a flange frame, a second holding frame is protected from external influences by a plug connector housing, and is able to be moved to be connected to the built-in holding frame by means of a corresponding electrical cable. However, independently of this design, a plug connection created by two cable plugs can also be contemplated.

While in similar plug connector structures plug modules are initially held in a separate frame, and the frame must then be screwed into a further housing part provided for this purpose, the design according to the invention has a frame which can be used simultaneously as a holding frame and housing frame to hold the module, and/or can be connected to a plug connector housing.

However, both holding frames have the same system for accommodating the plug modules inserted therein.

For this purpose, each holding frame contains a plug insert which is fixed, on a side thereof, inside a rectangular feedthrough opening in the holding frame via corresponding locking- and abutment contours on three sides.

In the U-shaped, angled side frame of the plug insert, molded tongues are incorporated both on the upper and lower edges thereof and the ends of the molded tongues are spaced apart and face into the rectangular feedthrough opening at an angle.

The plug modules advantageously have longitudinal webs, and the module can initially be inserted into the holding frame between the tongues of the plug insert by means of said longitudinal webs, to then be pushed onto glide rails molded onto the side of the holding frame (molded thereon perpendicular to the line traveled during the insertion of the plug modules) by means of cross webs molded onto the modules. The rectangular recess is finally filled completely with plug modules. This insertion process is carried out with no tools.

Because the plug modules inside a plug connection in the plug insert and in the holding frame must have a mirror-image configuration, each plug insert is designed in such a manner that the plug modules can only be inserted into the rectangular recesses when rotated about the axial dimension of the plug.

It is additionally advantageous that the plug modules can also be inserted into each of the holding frames from both sides, meaning from both the normal plug side with the mating plug, and also from the cable connection side.

An additional advantage of the plug insert according to the invention is that it also has devices to ensure a PE connection in the simplest manner, without tools—thereby connecting a protective line according to regulations. In one configuration, an electrical conductor can be connected to the plug insert in a plugable manner by means of a crimp connector; in another configuration, an electrical conductor, as a Litz conductor, can be plugged-in and establish a contact by means of an already disclosed device.

BRIEF DESCRIPTION OF THE DRAWINGS

These and other objects of the invention, as well as many of the intended advantages thereof, will become more readily apparent when reference is made to the following description taken in conjunction with the accompanying drawings.

One embodiment of the invention is illustrated in the figures, and is described in greater detail below, wherein.

DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
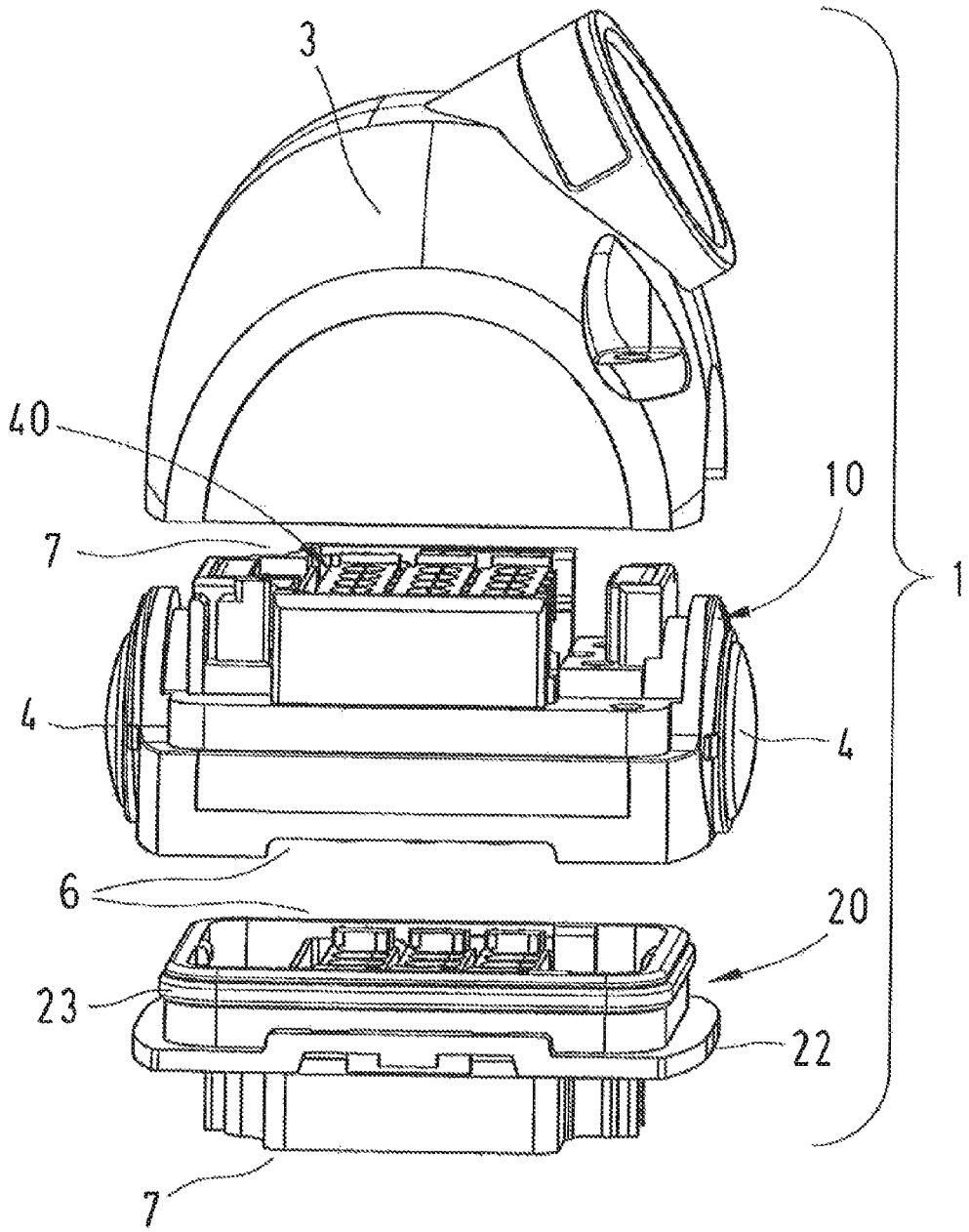
FIG. 1 shows a plug connector system in an exploded drawing.

FIG. 1 shows a plug connector system in an exploded spatial drawing, having a plug connector housing 3, a first housing frame 10, and a second housing frame 20 designed as a flange frame.

The housing frame is designed as a self-supporting first holding frame 10, and has, among other things, a locking unit 4 integrated into the housing frame, wherein the mechanism of the locking unit [4] is released by means of a pushdial configuration. Multiple plug modules 40 are arranged inside a rectangular feedthrough opening 11 of the holding frame 10, and correlate with plug modules 40' of a second holding frame 20 which matches the rectangular feedthrough opening [11].

In this case, the flange frame is installed on or in, and fixed to, any assembly, including a motor housing or circuit box housing, for example, and the mobile plug connector system, having the housing frame (holding frame 10), is connected to the fixed flange frame (of the second holding frame 20).

Each of the holding frames 10, 20 is designed for the plug modules 40, 40' to be inserted therein, and has corresponding contours for installation in the semicircular plug connector housing 3 or for a section of a housing.

However, the flange frame designed as the second holding frame 20 has a flange 22 around the periphery thereof, wherein said flange [22] has a collar in which a seal ring 23 is arranged, the same running around the periphery of the collar, for the purpose of securely sealing the Plug connection against external influences. The plug end 6 and the connection end 7 on the side of the cable are also indicated.

Figure 2:
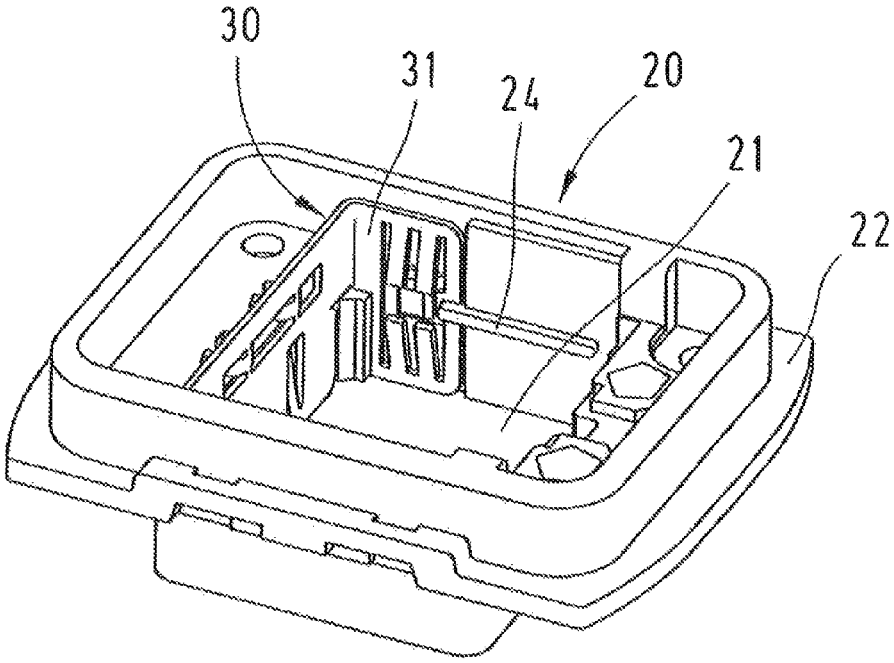
FIG. 2 shows a housing frame having a plug insert.

In FIG. 2, the holding frame 20 of the plug connector system is shown, along with its noticeable rectangular feedthrough opening 11, inside the flange 22 running around the periphery thereof, and having a plug insert inserted into the holding frame [20].

In this case the plug insert 30 is snapped into the holding frame in one of the narrow side regions, as a U-shaped component with side frames 31 bent at right angles.

Figure 3A:
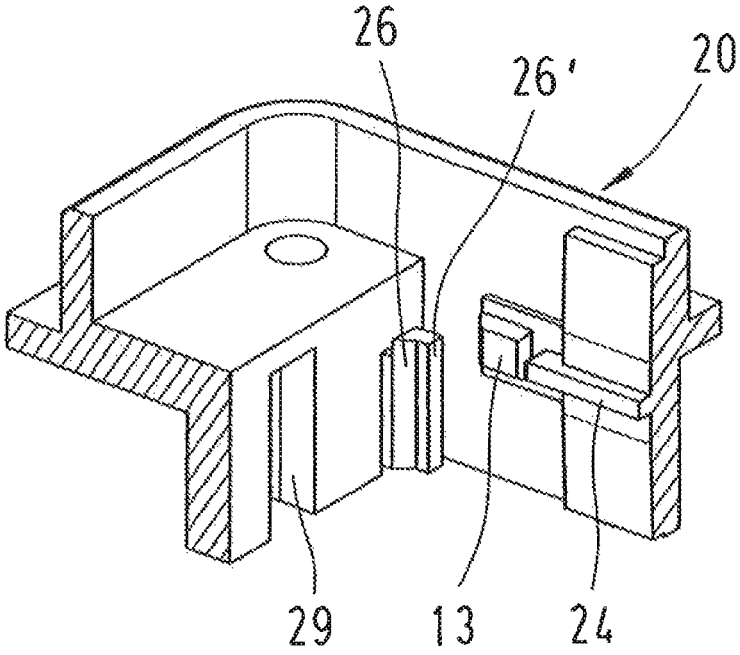
FIG. 3*a* shows a corner cutaway view inside the housing frame, according to FIG. 2.

FIG. 3*a* shows a corner cutaway view of the holding frame 20, viewed from the plug side 6.

The cutaway view shows multiple molded components which are responsible for the insertion of a plug insert 30 as well as for the functionality of the system.

Similarly, a partially free-standing pin 26 is shown, the same having a polarizing rail 26', as well as a recess 29 and a square projection 13.

Figure 3B:
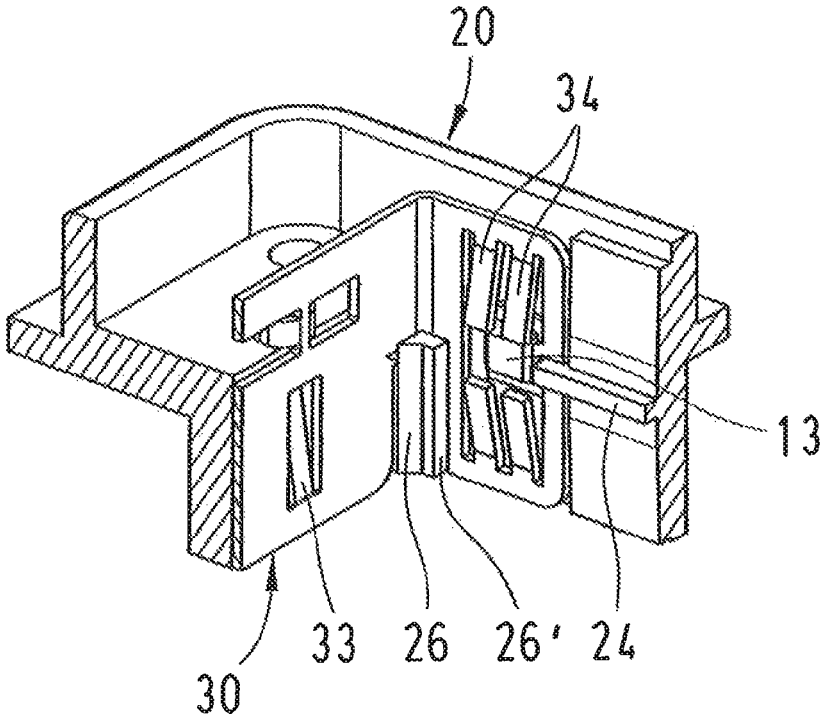
FIG. 3*b* shows a corner cutaway view of the housing frame having a plug insert, according to FIG. 2.

FIG. 3*b* shows the same cutaway view inside the rectangular feedthrough opening, with the plug insert 30 designed as an electrically conducting part which is held by means of the mounting link 33 and the pin 26. The plug insert 30 in this case is inserted into the rectangular feedthrough opening 21 from above from the plug side 6.

In this case, the plug insert 30 is pushed on the corner regions thereof behind each of the molded pins 26, and at the same time is held by means of a mounting link 33, the same engaging in recesses 29 in the holding frame 20, such that the configuration prevents further displacement of the plug insert 30.

Figure 4A:
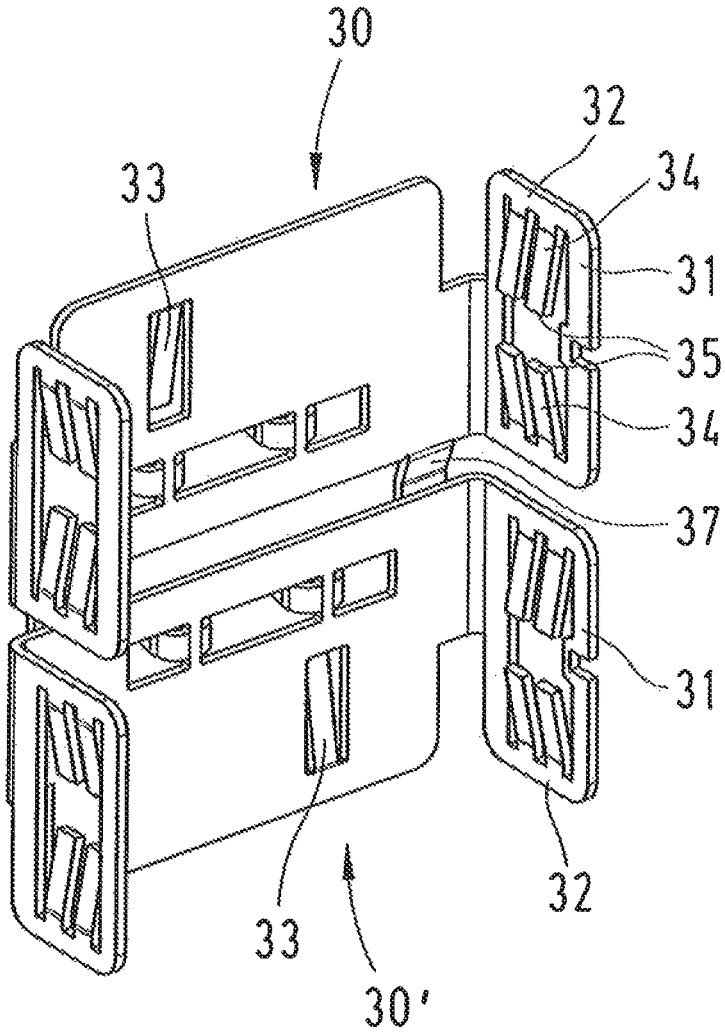
FIG. 4*a* shows two plug inserts arranged one on top of the other in perspective.

FIG. 4*a* shows two plug inserts 30, 30' in a perspective view, wherein the same are arranged in a connected system in the holding frame 10, 20. Here, the plug insert 30' differs only by being a mirror-image object.

Two tongues 34 which are oriented toward the inside from the upper and the lower edge 32 of the frame are molded in the side frames 31, wherein the tongue ends 35 thereof are spaced apart from each other in the interior space of the rectangular feedthrough opening 11.

The molded projection 13 with a rounded square shape on the long sides of the holding frame 20—and this applies as well for the first holding frame 10—which projecting into the center of the tongues 34 of the side frame 31, effectively constitutes a limit for the four tongue ends 35 of the plug insert 30, 30', and is at the same time the center of rotation for the perpendicular-to-horizontal sliding that takes place inside the holding frame 10 or 20, following the insertion of the plug module 40.

In addition, the configuration also includes contact links 37 in a wave-shaped construction at least on one side of the plug insert 30, 30', and these contact links [37] contact their respective opposite plug insert when the two housing frames 10, 20 are connected.

Figure 4B:
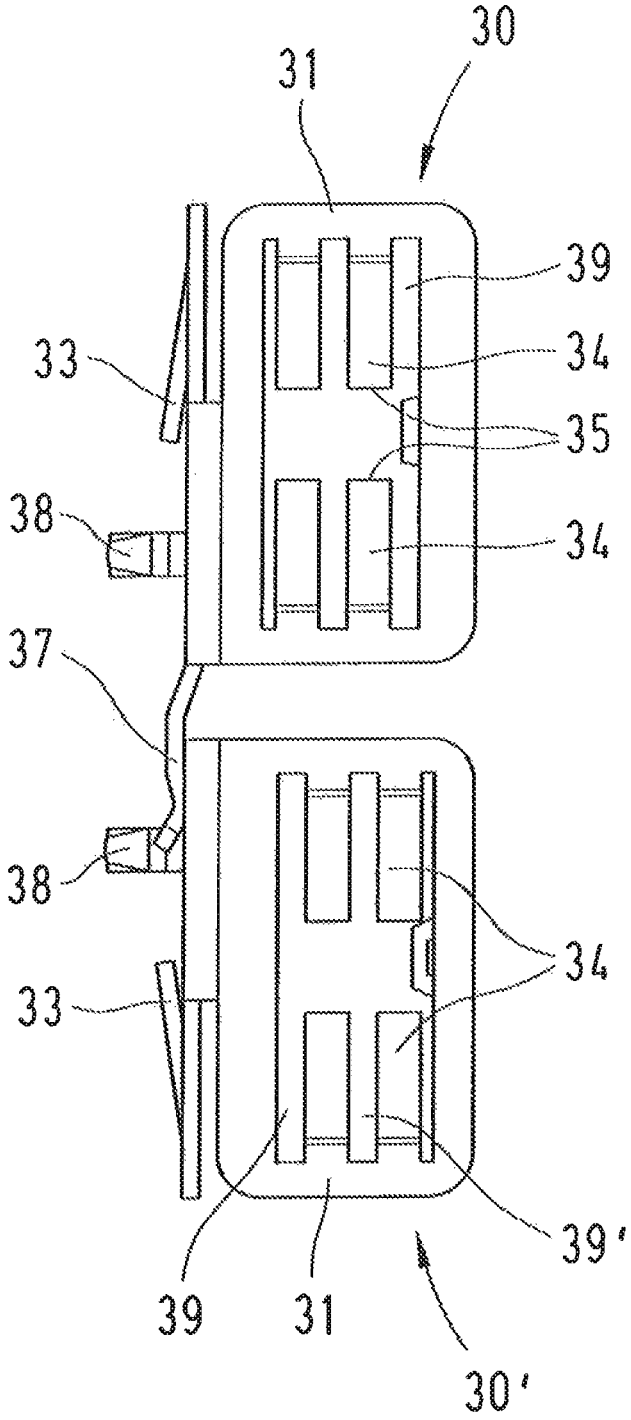
FIG. 4*b* shows two side frames of the plug insert arranged one on top of the other.

As can be seen in FIG. 4*b*, the tongues 34 are arranged in the side frames 31 of the plug inserts 30, 30' for both of the holding frames 10, 20 in such a manner that the side frame 31 shown above in this figure shows a polarization slot 39 on its outer side (which is exactly as wide as the central slot 39'), while on the lower side frame 31 the polarization slot 39 is arranged on the inside near the corner. Longitudinal webs 45 molded onto the narrow sides of a plug module 40 are inserted into both of the slots 39, 39'.

Figure 4C:
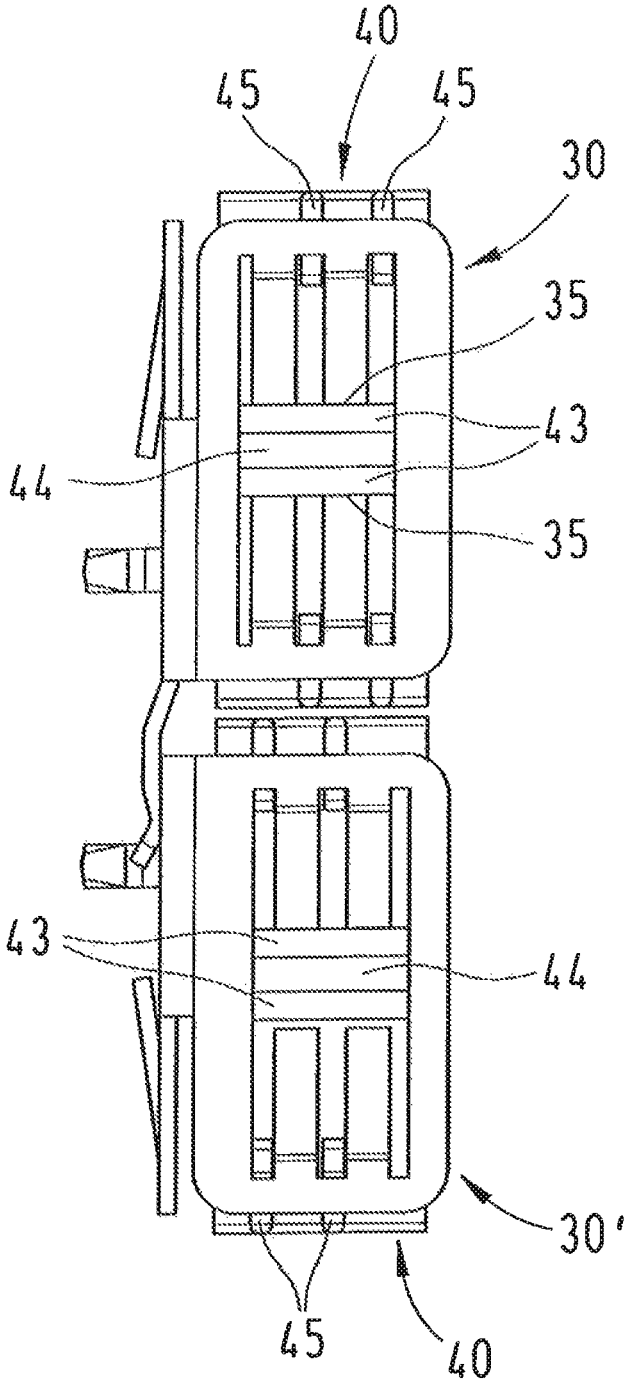
FIG. 4*c* shows a top view of the side frames of the plug inserts having plug modules in the inserted position.

In addition, FIG. 4*c* shows how the longitudinal webs 45 and the cross webs 43 engage from the plug modules 40 into the side frames 31 of both plug inserts 30, 30'. Each of the plug modules 40 has short longitudinal webs 45 on the edges of the narrow sides 41, as well as two cross webs 43 approximately in the middle of the narrow side, wherein said cross webs [43] are spaced apart by a groove 44.

To assemble the two holding frames 10, 20, the plug modules 40 are initially inserted and guided perpendicular to the respective holding frame, in the region of the plug insert 30, by means of the longitudinal webs 45, for the purpose of then being pushed, by means of the cross webs 43 and/or the groove. 44 arranged between the former, on two glide rails 14, 14' and 24, 24' molded onto the inside of the holding frames 10, 20 on opposite sides, until the plug modules [40] reach a stop in the rectangular feedthrough opening 11, 21.

The engagement of the longitudinal webs 45 between the tongues 34 and the polarizing slots 39, 39' initially ensures the possibility of the inserted plug modules 40 being polarized with no chance of confusion. In this case, the longitudinal webs 45 are molded onto the narrow sides 41 of the plug modules 40, 40' asymmetrically with respect to the width of the module housing, wherein the plug modules [40, 40'] are, in principle, similar or identical.

Figure 10:
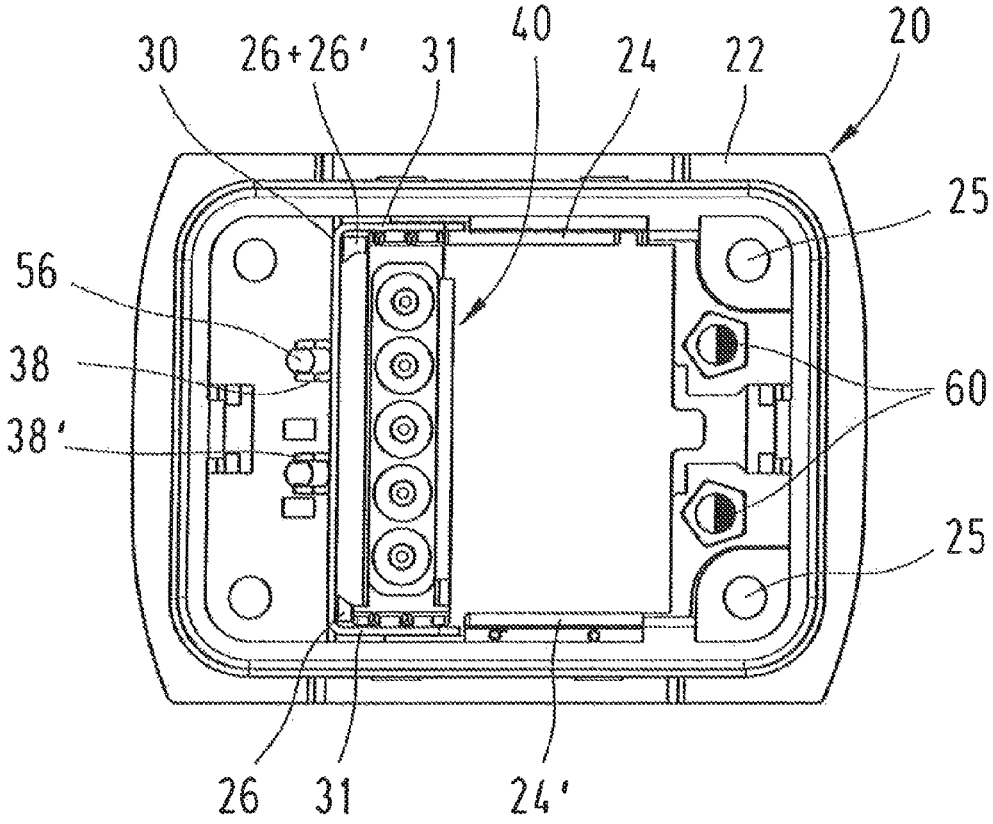
FIG. 10 shows a top view of a holding frame having a plug module and a coding using a pentaprism.

Moreover, for the purpose of making the connection polarity unmistakable, one of the pins 16, 26 in the holding frame 10, 20 is configured with an additional polarization rail 16', 26' which is molded onto the holding frame [10, 20] and Which prevents an incorrect connection because the region of the plug module 40, 40' intended for this region of the holding frame [10, 20] has a narrower construction than on the opposite side. On said opposite side, the pin 16, 26 does not have an additional molded rail (see FIG. 3*b* as well). In addition, FIG. 10 shows that the lengths of the glide rails 24, 24', for example, are different, such that only the narrower side of a plug module can be inserted into the corresponding recess between the pin 26 and the longer glide rail 24. In this way, the configuration ensures that two plug modules arranged opposite one another in mutually connected holding frames cannot be connected in any other way which would lead to destruction of components or systems.

Figure 5:
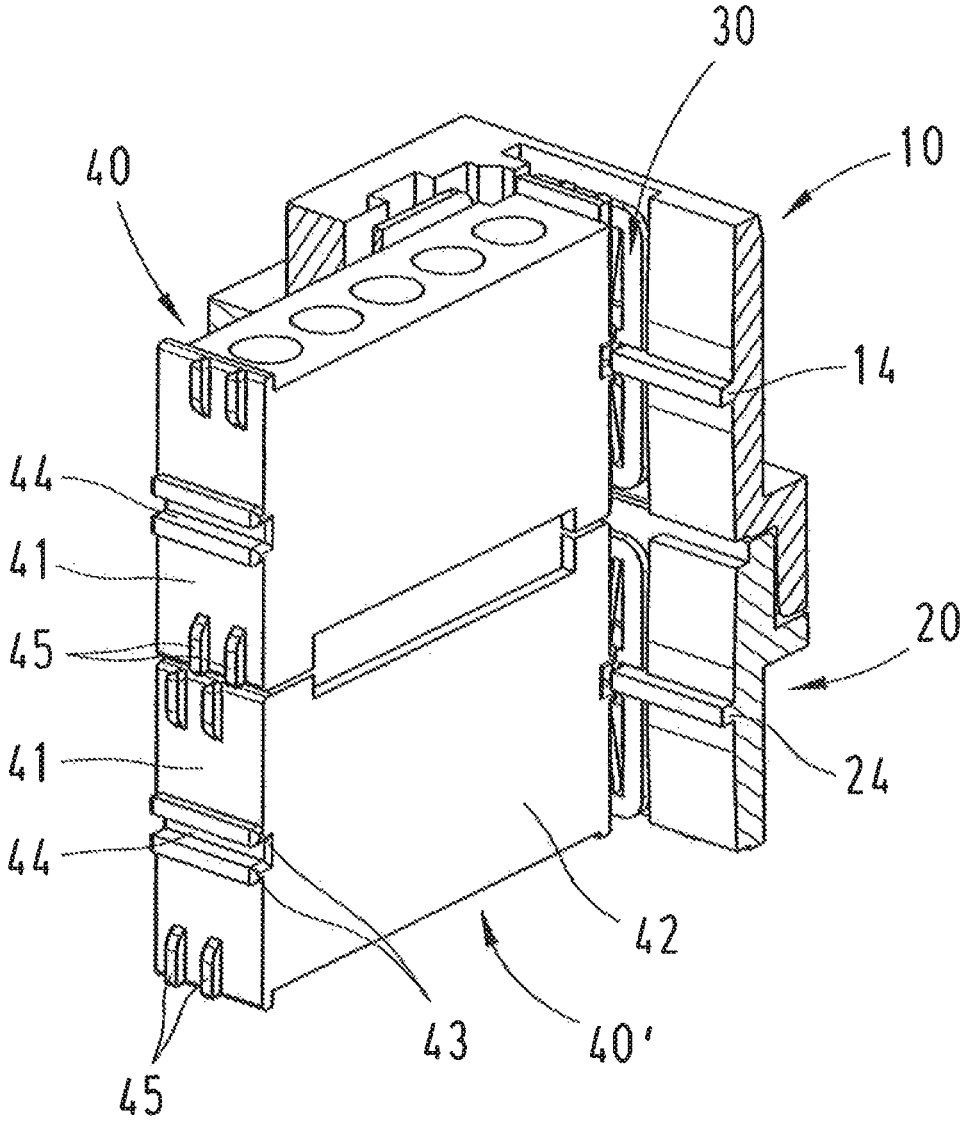
FIG. 5 shows a perspective illustration of a corner cutaway view of two housing frames which are arranged one on top of the other and which have two plug modules.

FIG. 5 shows a perspective view and a partial cutaway view of the holding frames 10, 20, wherein two plug modules 40, 40' are inserted into the two holding frames and rotated laterally by 180° to each other. In this case, one of the side frames of the plug inserts is not shown.

The longitudinal webs 45 on the narrow sides 41 of the plug modules 40, 40', each being offset, are clearly visible.

Figure 6:
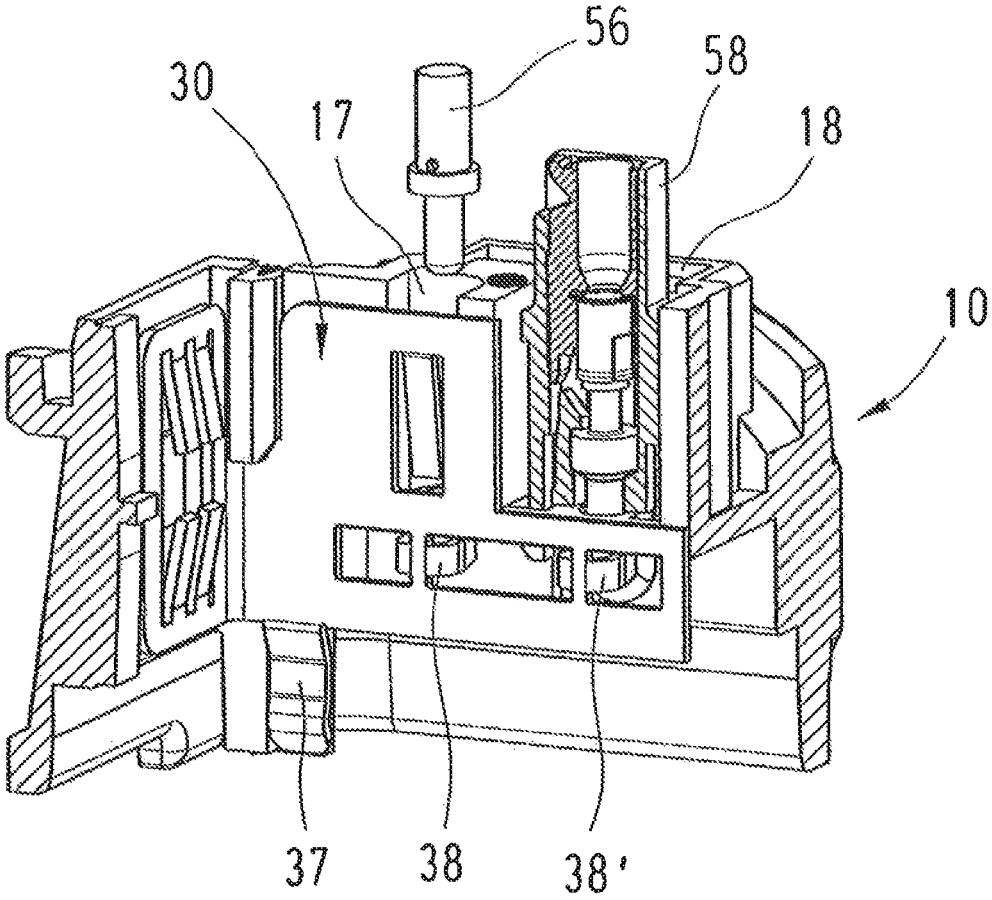
FIG. 6 shows a perspective partial view of a housing frame having two alternative PE connector elements.

In addition, the figure shows how the plug module 40 can be pushed horizontally on the glide rails 14, 14' or 24, 24' after the plug module [40] has been inserted perpendicularly by means of the groove 44 and the cross webs 43 which divide the same. In order to transmit or to continue the protective function of a prescribed protective line inside the plug connector, a special connection for the protective line is configured on each of the plug inserts 30, as indicated in FIG. 6.

In this configuration, the possibility exists of connecting a crimp contact 56 to a corresponding electrical conductor, and to insert this crimp contact 56 into a square recess 17 in the holding frame 10, for example, and to establish contact with the plug insert 30 by means of two contact tongues 38 which curve off of the crimp contact [56] in a U shape.

On the other hand, a further, rectangular recess 18 is included in the holding frame 10, wherein a known connector element 58 having a separate function is inserted into this rectangular recess [18], and is provided for establishing contact with electrical conductors known as Litz conductors.

Also for this purpose, two U-shaped contact tongues 38' are configured on the plug insert 30, and reach into the connector element 58 for the purpose of establishing a contact. Both connections made to establish the PE contact are realized via the cable connection side 7 of the first holding frame 10 as well as the second holding frame 20, wherein the latter is not further displayed.

Figure 7:
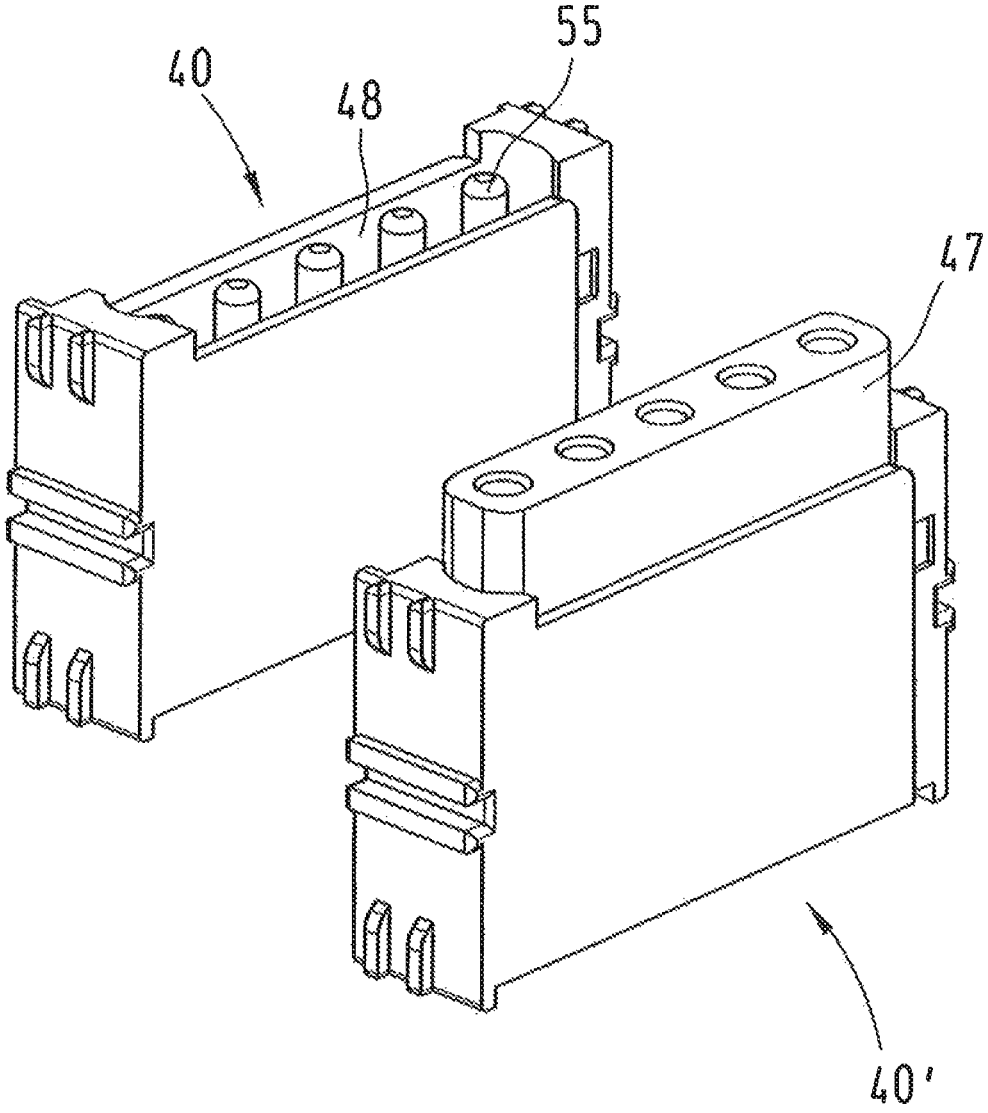
FIG. 7 shows a perspective view of two plug modules.

FIG. 7 shows an example of two plug modules 40, 40', wherein a first plug module 40 contains pin terminals 55, and a second plug module 40' (not visible) contains socket contacts. In this case, the second plug module 40' having the socket contacts is configured with a collar 47 which can be inserted into a corresponding recess 48 of the first plug module 40, for the purpose of establishing a contact with the pin contacts 55. In addition, in one possible variant, both plug modules are equipped with pin or socket contacts, and a separately manufactured adapter is likewise designed like a collar which is snapped onto and locks with one of the plug modules 40. For this purpose, then, this adapter is configured with contacts that are complementary to the contacts in each of the plug modules.

Figure 8:
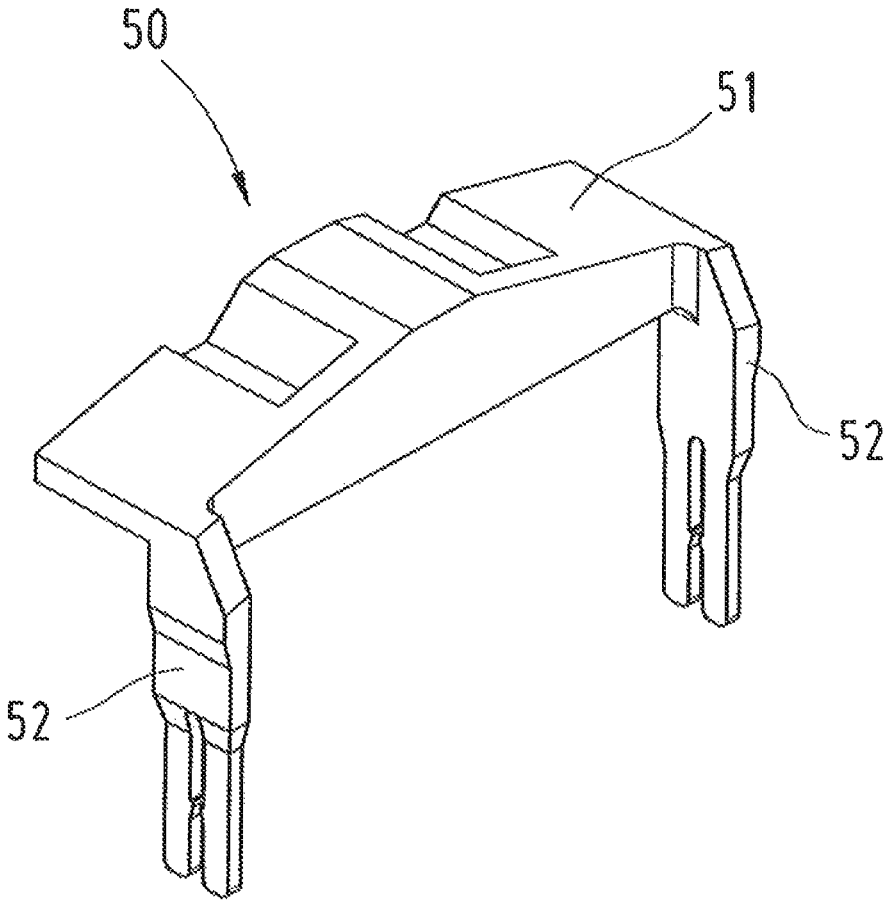
FIG. 8 shows a disassembly tool for plug modules.

A yoke-shaped disassembly tool 50, as shown in FIG. 8, is necessary to remove one or more plug modules 40 from one of the holding frames 10, 20. The side brackets 52 of the disassembly tool [50] which are angled parallel to the narrow sides 41 of the plug modules 40, 40' are slid over the narrow sides of the plug module 40, 40', the same being inserted in the plug insert 30.

In this case, the tongues 34 on the plug insert 30 are bent outward, such that the latch they have with the cross webs 43 of the plug module 40, 40' is released, and the module can be removed from the plug insert 30 and therefore from the respective holding frame.

The neighboring plug module 40 must first be slid laterally in the region of the plug insert 30 before the latch of the tongues 34 can be released by means of the disassembly tool 50.

Also, according to the configuration, the plug modules can be pulled out of their frame on either side.

That is, in the direction 6 in which the connection is made, or in the opposite direction of the connection side 7 of the holding frame 10, 20.

Figure 9:
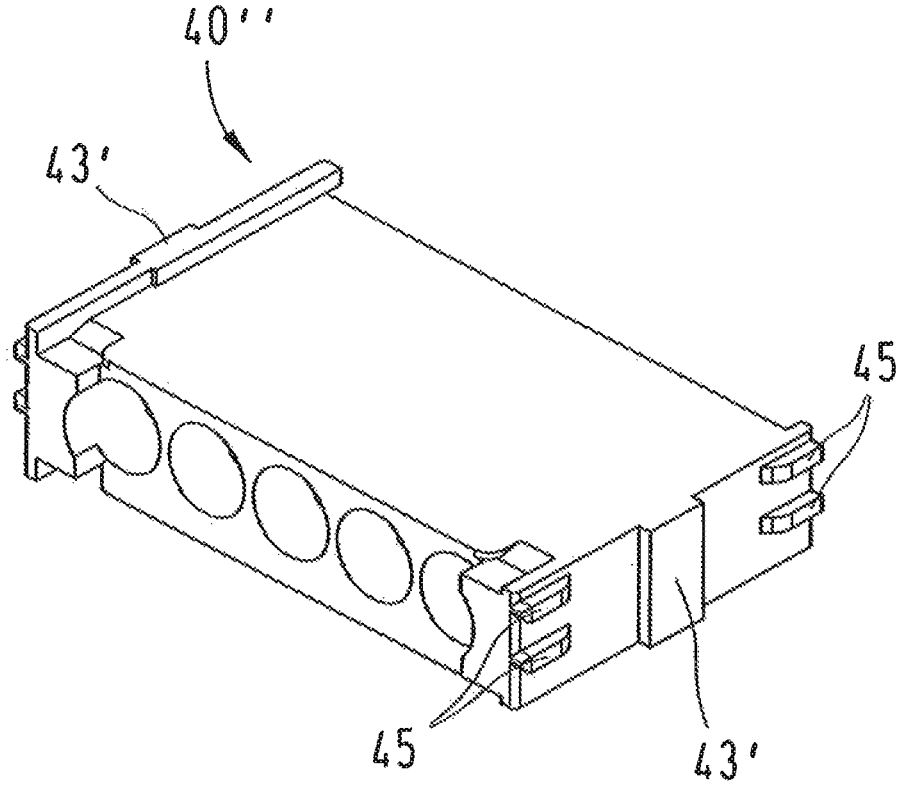
FIG. 9 shows a variant of plug modules.

In addition, in a second embodiment, a plug module 40" as shown in FIG. 9 is not intended to be able to slide laterally within the holding frame 10, 20, for particular applications, wherein the plug module [40"] is only inserted in the region of the plug insert 30 either in or against the direction in which the connection is made.

For this purpose, the two cross webs 43 have been merged together into one cross web 43' on the narrow side of the module, such that no groove is available for guiding a sliding motion onto the glide rails 14, 14', 24, 24'.

In addition, in both of the holding frames 10, 20 of this plug connection, a mechanical coding is included using two pentaprism posts, for the purpose of providing a differentiating feature for correct connections in cases where a number of similar plug connector housings are connected together.

For this purpose, at least one 5-sided coding post 60 is configured in each holding frame 10, 20 on the plug side thereof, as shown in FIG. 10, and each of these coding posts [60] is divided in half through the center thereof, and can be plugged into a particular matching (or even non-matching) opposite recess, such that only the matching recess positions allow connection of the two housing parts.

In this case, number symbols are included for the different recess positions, which are numbered with the digits 0-4 for the first posts, and 5-9 for the second posts in the 2-part coding system provided here. In this way, up to 25 combinations are possible.

In addition, the top view of the holding frame 20 designed as a flange frame also illustrates a plug insert 30 having a plug module 40 inserted into the same.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE NUMBERS

1 plug connector system
2
3 housing
4 latching/locking mechanism
5
6 plug side
7 connection side
8
9
10 housing frame, holding frame 1
11 rectangular feedthrough opening
12 recess for 33
13 projection
14, 14' glide rail, long horizontal; 14' glide rail, short
15 longitudinal bar with
16, 16' (pin; 16' polarization rail)
17 recess, crimp contact
18 recess, easy lock, for Litz conductor
19
20 flange frame, holding frame 2
21 rectangular feedthrough opening
22 peripheral flange
23 peripheral seal ring
24, 24' glide rail, horizontal; 24' opposite, short
25 opening for screw connection
26, 26' pin; 26' polarization rail.
27 recess, crimp contact, PE
28 recess for (easy lock) for Litz conductor, PE
29 recess for 33
30, 30' plug insert (locking element), U-shaped; 30' opposite plug insert, flange
31 side frame,
32 upper and lower edge
33 mounting links
34 tongues
35 tongue ends
36 angled latch (not mentioned)
37 contact latch, wave-shaped
38, 38' contact tongues for PE conductor, U-shaped,
39, 39' polarization slot; 39' central slot
40, 40' plug module; 40' second plug module, 40" variant
41 narrow sides
42 long sides
43, 43' 2 narrow cross webs; 43' a wide cross web
44 groove
45 longitudinal webs
46
47 collar
48 recess for 47
49
50 disassembly tool
51 U-shaped bracket
52 side bracket, slotted longitudinally
53
55 pin contacts
56 crimp contact for PE
57
58 contact element for FE.
59
60 coding posts

The invention claimed is:

1. A plug connector system including a holding frame in which electrical contacts are held in separate plug modules, said holding frame defining a plug end and a connection end, said holding frame enabling receipt of a surrounding housing or enabling the surrounding of a second holding frame/flange frame, wherein said holding frame includes a rectangular feedthrough opening with a holding device for holding the plug modules, and wherein said plug modules are insertable into the rectangular feedthrough opening from both the plug end and the connection end.

2. The plug connector system according to claim 1, wherein said holding device comprises a plug insert arranged in each rectangular feedthrough opening within which the plug modules are arranged to be inserted in the holding frame and fixable in the rectangular feedthrough opening.

3. The plug connector system according to claim 2, wherein said plug insert is a separate U-shaped and electrically conductive piece and abuts the inside of the rectangular feedthrough opening of the holding frame on three sides.

4. The plug connector system according to claim 3, wherein said plug insert is fixed in the rectangular feedthrough opening by means of mounting links which work outward in a recess in the holding frame, and by means of a pin which projects out of the corner regions of the holding frame.

5. The plug connector system according to claim 3, wherein said plug insert has, in its U-shaped side frames, two free-standing tongues which are arranged parallel and which face into the center of the side frames, one on the upper and one on the lower edge, and the tongue ends of the tongues, the same being spaced apart, are bent into the rectangular feedthrough opening.

6. The plug connector system according to claim 2, characterized in that the plug modules have two cross webs separated by a groove on each of their narrow sides, and in that two longitudinal webs are also arranged on the upper and the lower edge on the narrow sides, wherein the longitudinal webs are molded-on in a configuration which is asymmetric with respect to the width of the narrow sides.

7. The plug connector system according to claim 6, wherein glide rails are constructed in the rectangular feedthrough opening of the holding frame and arranged opposite each other, and the respective groove between the cross webs of the plug module engages with its respective glide rail, and enables a lateral sliding of the plug module in the holding frame.

8. The plug connector system according to claim 7, wherein a plug module can only be inserted into the rectangular feedthrough opening in the region of the plug insert in the holding frame, either in or against the direction in which the connection is made, wherein a displacement on the glide rails is prohibited by the design of a wide cross web.

9. The plug connector system according to claim 2, further comprising contact tongues for the purpose of establishing a contact between a protective line and the electrically conductive plug insert, and these contact tongues can be connected to a crimp contact or to a contact element for Litz conductors.

10. The plug connector system according to claim 2, further comprising a mechanical coding included in the holding frames, having two pentaprism posts which can rotate independently of each other, and which plunge into corresponding 5-sided depressions to join two posts divided in half to create a plug connection, and to provide reference to a differentiating feature for similarly constructed plug connectors.

* * * * *